United States Patent [19]

Hesse

[11] Patent Number: 4,846,756

[45] Date of Patent: Jul. 11, 1989

[54] TOY AUTOMOBILE FOR TOY ROADWAYS

[76] Inventor: Kurt Hesse, Waldstrasse 36, D-8510, Furth, Fed. Rep. of Germany

[21] Appl. No.: 148,213

[22] PCT Filed: Apr. 13, 1987

[86] PCT No.: PCT/DE87/00169

§ 371 Date: Feb. 22, 1988

§ 102(e) Date: Feb. 22, 1988

[87] PCT Pub. No.: WO87/06849

PCT Pub. Date: Nov. 19, 1987

[30] Foreign Application Priority Data

May 13, 1986 [DE] Fed. Rep. of Germany ..... 3615986

[51] Int. Cl.[4] ..... A63H 17/36

[52] U.S. Cl. ..... 446/460; 446/469

[58] Field of Search ..... 446/460, 468, 462, 466, 446/469, 442, 443, 454, 455, 456, 437, 470; 273/86 B

[56] References Cited

U.S. PATENT DOCUMENTS

| | | | |
|---|---|---|---|
| 1,927,233 | 9/1933 | Forner | 446/454 |
| 2,703,534 | 3/1955 | Copeland | 273/86 B X |
| 3,406,480 | 10/1968 | Joffe | 446/468 |
| 4,156,987 | 6/1979 | Lahr | 446/454 X |
| 4,453,712 | 6/1984 | Lee | 446/460 X |
| 4,571,213 | 2/1986 | Ishimoto | 446/460 X |

FOREIGN PATENT DOCUMENTS

| | | | |
|---|---|---|---|
| 2809250 | 9/1978 | Fed. Rep. of Germany | 446/460 |
| 2372641 | 6/1978 | France | 446/460 |
| 2445160 | 7/1980 | France | 446/460 |

*Primary Examiner*—Mickey Yu

*Attorney, Agent, or Firm*—Collard, Roe & Galgano

[57] ABSTRACT

In a toy automobile for toy roadways with an electric driving motor supported by the chassis of the vehicle, the latter being supportable when in motion on lateral guiding elements of the toy roadways by turning of the front wheels, the chassis of the vehicle is divided crosswise for reducing the expenditure of components and for making the steering functions safe, forming a front chassis part and a rear chassis part, and the two parts of the chassis are rotatably and pivotably connected with one another by an articulated pin with little play, whereby the rear chassis part supports the driving motor and front chassis part supports a common axle for the front wheels, such axle swinging freely. In addition, with a plate-like extension, the front axle extends across the rear chassis part, and for pivoting the front axle when the vehicle is in motion, a section of the extension is in friction-grip contact with a driving pinion, the latter being rotatable in both directions, until the one or other position of pivoting is reached, and the friction grip between the extension and the driving pinion is cancelled when the vehicle is not in motion.

4 Claims, 1 Drawing Sheet

TOY AUTOMOBILE FOR TOY ROADWAYS

The present invention relates to a toy automobile for toy roadways, having an electric driving motor supported by the chassis of the vehicle, which, when in motion, is supportable on lateral guide elements of the toy roadways for turning of the front wheels.

With toy automobiles, it is well known to support the front wheels on the single-piece chassis of the toy automobile by means of separate axle journals, and to turn the latter via lever gears in the one or the other direction. In many cases, the lever gears are driven via gear. Aside from the fact that such known toy automobiles are costly to manufacture due to the great number of components needed, such toy vehicles are susceptible to trouble as a result of the complicated design of the steering mechanism.

The object of the present invention is to reduce the number of components of the type of toy vehicles described above, and to make the steering functions thereof safer.

According to the present invention, this object is accomplished by providing a chassis of the toy vehicle divided crosswise, forming front and rear chassis parts; that the two parts of the chassis are pivotably and tiltably linked by an articulated pin with little play; that the rear part of the chassis supports the driving motor and the front part of the chassis supports a common axle for the front wheels, such axle being able to turn freely; that a plate-like extension of the axle, extends to the rear part of the chassis; and that a section of the extension, for turning the axle while the toy vehicle is in motion, is in friction-grip contact with a driving pinion, the latter being rotatable in both directions, whereas such friction grip between the extension and the driving pinion is cancelled when the toy vehicle is not in motion. Preferably, the axle has the extension in the center between the front wheels, and axially on the side averted from the extension, it has a forwardly projecting attachment for receiving a swinging axle for the axle of the front wheels. According to another feature of the invention, the axle, the extension and the attachment may be formed of a single molded part, for example an injection molded part. In this way, a steering system formed of only a few parts is created for the toy vehicle, which steering system automatically turns the front wheels to one side or the other when the vehicle is in motion, such turning of the wheels conforming to the direction of rotation of the motor, whereas the front wheels are not turned when the vehicle is not in motion. The tiltable link between the two parts of the chassis assures the required friction grip between the extension and the driving pinion when the toy vehicle is in motion. By the influence of the thrust applied to the rear part of the chassis by the driving motor, the front part of the chassis tilts downwardly in the forward direction within the region of the joint, whereby the extension is forced or pressed against the driving pinion, so that when the toy vehicle is not in motion, the front part of the chassis with its extension tilts back upwardly due to the absence of thrust, and the active connection between the extension and the driving pinion is cancelled. Finally, the arrangement of the attachment and the design or embodiment of the swinging axle ahead of the axle of the front wheels at the same time result in a torque being permanently applied to the axle when the toy vehicle is in motion, which torque acts as a resetting force in the lengthwise direction of the toy vehicle in the sense of an alignment of the axle and the front wheels. When the toy vehicle is in motion, the turning forces acting on the axle are, of course, greater than the resetting force. The result of the embodiment of the toy vehicle of the present invention thus is that by simple pole-changing and changing the direction of rotation of the driving motor, the axle with its front wheels is turned so as to support the toy vehicle on the one or other guiding element, for example when changing driving lanes.

In order to relieve the driving pinion for the duration of driving motions with the front wheels turned, it is proposed based on another feature of the toy vehicle that the section of the extension that is in friction-grip contact with the driving pinion is bounded on both lateral sides by recesses or grooves, and that such recesses or grooves are disposed beneath the driving pinion when the axle is in the one or other final position of turning. This permits the driving pinion to turn freely and without loss of force, for example for driving motions, when the axle is in the final position of turning, even though the front axle remains in the position of turning with the front part of the rear chassis part tilted downwardly in the forward direction.

The invention is explained in greater detail in the following by references to the embodiment shown in the drawing, in which.

Figure 1:
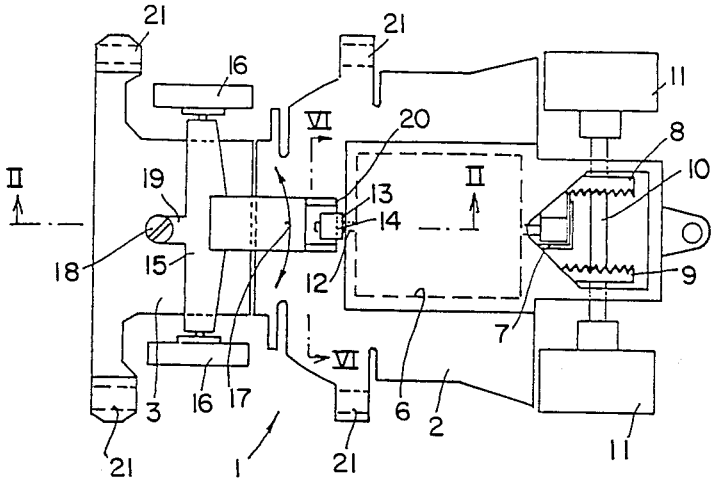
FIG. 1 is a top view of the chassis of a toy vehicle.
Figure 2:
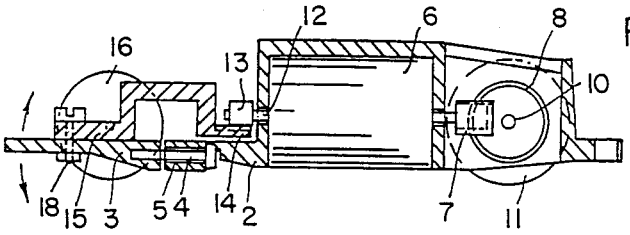
FIG. 2 is a cross-sectional view of the chassis of the toy vehicle taken along line II—II of FIG. 1.

In FIG. 1, reference numeral 1 denotes the chassis of a toy vehicle, which chassis is formed by a rear chassis part 2 and a front chassis part 3. In particular FIG. 2 shows that the two chassis parts 2 and 3 are rotatably connected with one another by an articulated pin 4. In the embodiment shown in the drawing, the articulated pin 4 is guided with little play in a recess 5 of the chassis part 2, which permits the chassis part 3 to be slightly tiltable against the chassis part 2. The latter supports an electrical driving motor 6, which mates with the crown gears 8 and 9 via the reversing cage gear 7, such crown gears being rigidly mounted with a spacing between each other on an axle 10 for the rear wheels 11. In this way, forward driving motions of the toy vehicle can be achieved when the shaft 12 of the driving motor 6 is rotating.

Furthermore, a friction pinion 13 is rigidly mounted on the shaft 12, rotating with respect to an extension 14, the latter being rigidly connected with the axle 15 for the front wheels 16. Preferably, such extension forms one piece with the axle 15, so that when the extension 14 is turned, the axle 15 is swings as indicated by the arrows 17. The axle 15 is jointed with the chassis part 3 by means of a screw 18 serving as the swivelling axis. Such screw 18 extends through a bore in an attachment 19, which projects beyond the axle 15 in the forward direction, which automatically applies to the axle 15 an alignment component for the straight run of the toy vehicle as the latter is in motion.

Figure 3:
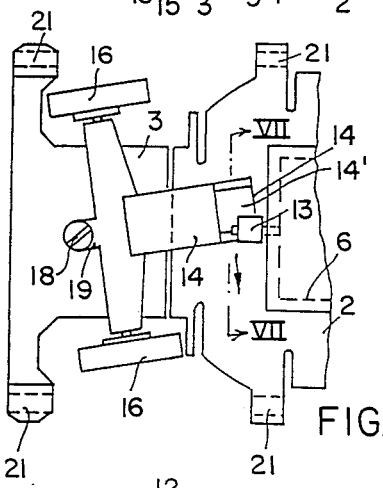
FIG. 3 is a top view of part of the toy vehicle.
Figure 4:
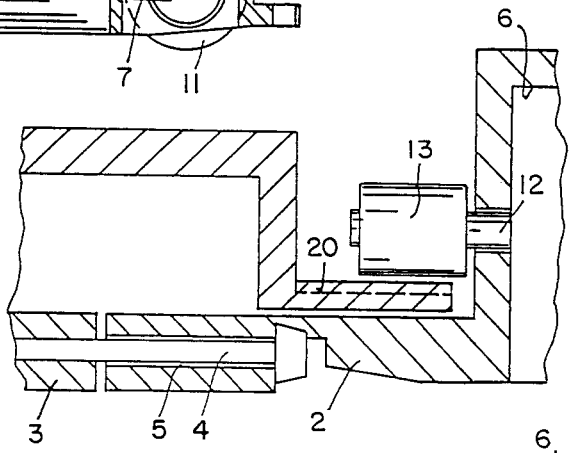
FIG. 4 is an enlarged partial cross-section of a toy vehicle in the resting position, taken along line IV—IV of FIG. 1.
Figure 5:
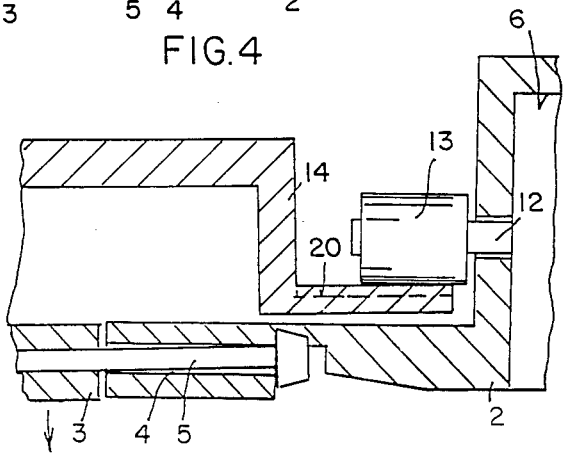
FIG. 5 is an enlarged partial cross-section of the toy vehicle similar to that of FIG. 4 in the driving position.
Figure 6:
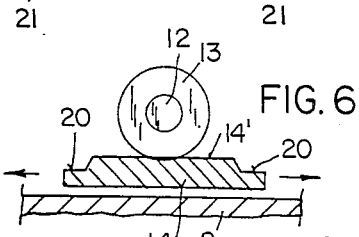
FIG. 6 is an enlarged partial cross-section of the toy vehicle taken along line VI—VI of FIG. 1.
Figure 7:
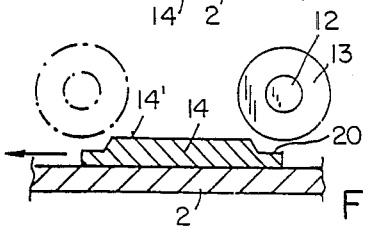
FIG. 7 is another partial cross-section of the toy vehicle taken along line VII—VII of FIG. 3.

In the resting position, that is, when the driving motor 6 is not rotating, the axle 15 can assume the position, for example the one shown in FIG. 1, whereby the front wheels 16 assume the position for straight run. In the latter position, a downward tilting motion takes place in the rearward direction under the influence of the weight of the extension 14, and the friction-grip connection between the extension 14 and the friction pinion 13 is discontinued as shown in FIG. 4. When the driving motor 6 is connected to a power source (not shown) and the toy vehicle starts to run, a forwardly directed tilting moment is applied to the chassis part 3 under the influence of the thrust, which moment brings the extension 14 in active friction grip connection within the zone of the center section 14' due to tilting (FIGS. 3 and 5). The extension 14 is swivelled to the left or right in accordance with the direction of rotation of the driving motor 6, jointly swinging the axle 15 and the front wheels 16. On reaching a final position (FIG. 3), the friction pinion 13 is disposed on top of a recess 20 (FIG. 7), which cancels the friction grip between the extension 14 and the friction pinion 13. In this position of the extension 14, the friction pinion 13 is capable of continued frictionless rotation without motor losses. Any resettings of the extension 14 under the influence of driving motions are compensated in each case by active reconnection between the extension 14 and the friction pinion 13.

After the driving motions have ended, the chassis part 3 with its extension 14 is automatically tilted back into the position shown in FIG. 4 due to the absence of thrust, which cancels the friction grip between the extension 14 and the friction pinion 13 and the axle 15, under the influence of an alignment force, can automatically swing back around the screw 18 for straight run. Reference numeral 21 denotes guide elements for the toy vehicle, which are supportable on baffles laterally connected with he roadways (not shown).

I claim:

1. A toy vehicle for toy roadways, comprising:

a vehicle chassis transversely divided to form a front and a rear chassis segment;

an electric drive motor carried by the rear chassis segment;

a common shaft for a pair of front wheels, said shaft being carried by the front chassis segment affording free pivoting motion;

a pin joint linking said front and rear chassis segments in such a way that the two chassis segments are joined together affording both rotary and tilting motion with modest play; and a platform-shaped projection connected to the said common shaft for said front wheels, extending to the rear chassis segment and having a rear portion facing said rear chassis segment which, while the toy vehicle is running, enters into frictional contact with a bi-directionally swivelling motor pinion connected to the drive motor so as to achieve swivelling movement of the common front wheel shaft until either of two extreme swivelling positions is reached, whereas when the toy vehicle is stationary, the frictional contact between the rear portion of the platform-shaped projection and the motor pinion is disengaged.

2. The toy vehicle according to claim 1, wherein said common front wheel shaft includes a tongue with a pivoting vertical axis for the front wheel shaft operating in conjunction with the front segment of the chassis, said tongue facing away from the platform-shaped projection and being positioned halfway between the front wheels.

3. The toy vehicle according to claim 2, wherein said platform-shaped projection and said tongue are connected with the common front wheel shaft as a single molded unit.

4. The toy vehicle according to claim 1, wherein said rear portion of the platform-shaped projection in frictional contact with the motor pinion includes notched setbacks on two opposite sides so that in the extreme swivel end positions of the shaft these notched setbacks are spaced below said motor pinion.

* * * * *